US005947755A

United States Patent [19]

Conway

[11] Patent Number: 5,947,755

[45] Date of Patent: Sep. 7, 1999

[54] ELECTRICAL OUTLET SAFETY CAP WITH ROTATABLE PRONGS

[76] Inventor: Davis R. Conway, 2341 Wesbriar Ct., Maryland Heights, Mo. 63043

[21] Appl. No.: 09/044,113

[22] Filed: Mar. 19, 1998

[51] Int. Cl.[6] ..... H01R 13/44

[52] U.S. Cl. ..... 439/148; 439/953

[58] Field of Search ..... 439/135, 142, 439/148, 149

[56] References Cited

U.S. PATENT DOCUMENTS

| | | | |
|---|---|---|---|
| 4,407,554 | 10/1983 | Drall . | |
| 4,426,121 | 1/1984 | Stoewe et al. | 439/148 |
| 4,662,603 | 5/1987 | Moses | 439/148 |
| 4,801,271 | 1/1989 | Piper . | |
| 5,006,076 | 4/1991 | Robinson et al. | 439/148 |
| 5,017,148 | 5/1991 | Buckshaw . | |
| 5,024,603 | 6/1991 | Hsieh | 439/148 |
| 5,813,873 | 9/1998 | McBain et al. | 439/148 |

*Primary Examiner*—Steven L. Stephan
*Assistant Examiner*—J. F. Duverne

[57] ABSTRACT

A safety cap for an electrical outlet, including a face plate having an opening, a rotatable mounting element including a disk positioned in the opening of the face plate, and at least one prong having one end attached to one side of the disk and extending substantially normal to the face plate, the at least one prong having a transversely extending member along one edge for fixing the face plate to the electrical outlet.

20 Claims, 2 Drawing Sheets

ELECTRICAL OUTLET SAFETY CAP WITH ROTATABLE PRONGS

TECHNICAL FIELD

This invention relates generally to safety caps for electrical wall outlets, and more particularly, to a cap with rotatable prongs to prevent unintended removal of the safety cap.

BACKGROUND ART

Small children can be protected against electric shock and injury by inserting safety caps in electrical outlets so that metal objects cannot be easily inserted into the receptacle slots.

The prior art includes several safety plug devices consisting of caps having electrically non-conducting prongs which can be inserted into the outlet holes as shown in FIG. 1. As children grow older, they often discover how to remove these plugs from the socket simply by observing others remove the plugs or by playing with the caps in such a way that they eventually learn how to pry them from the socket. A need therefore exists for means to help prevent the plug from being unintentionally removed from the socket.

There are devices in the prior art for retaining a safety cap near an outlet when not in use. U.S. Pat. No. 5,017,148 issued to Buckshaw, for example, discloses safety plugs attached to a tether. The tether is attachable to the face plate of the outlet to retain the plugs near the outlet when the plugs are not in use. The Buckshaw device and other similar tether devices do not disclose means for retaining the prongs of the plugs in the outlet during use, however.

There are likewise numerous devices attachable to a plug connected to an electrical appliance to prevent the plug from being pushed into an electrical socket, such as U.S. Pat. No. 4,407,554, for example. Such devices are useful to prevent a particular device from being operated but do not address the problem of other electrically conductive objects, such as metal keys, being pushed into an electrical outlet by a child.

Accordingly, the present invention is directed to overcoming one or more of the problems as set forth above.

DISCLOSURE OF THE INVENTION

In one embodiment of the present invention, a safety cap for an electrical outlet includes a plug face plate and two prongs, each prong having a transversely extending member along an edge and being attached to the plug face plate at one end with rotatable mounting means. The rotatable mounting means includes a disk that is positionable in a similarly sized opening in the plug face plate. The opening is sized to retain the disk by frictional force while allowing the disk to be rotated when enough force is applied to overcome the frictional force. The prongs are substantially parallel to slots in the electrical outlet when the safety cap is inserted into the outlet. After the prongs are inserted, the present invention includes means for rotating the disks until the transversely extending members engage the edge of an inner portion of the electrical outlet, which prevents the safety cap from being removed until the prongs are rotated back to their original position. A cover may be placed over the safety cap to prevent access to the means for rotating the disks.

BEST MODE FOR CARRYING OUT THE INVENTION

Figure 3:
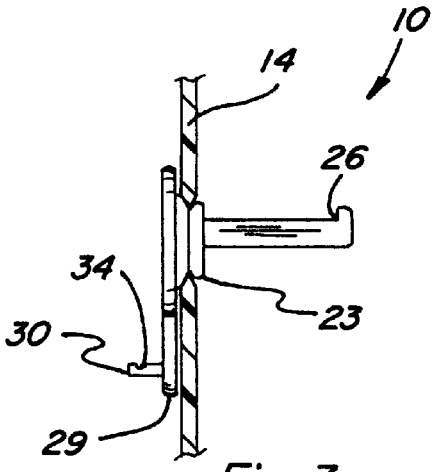
FIG. 3 is a side view of a safety cap according to the present invention.
Figure 2:
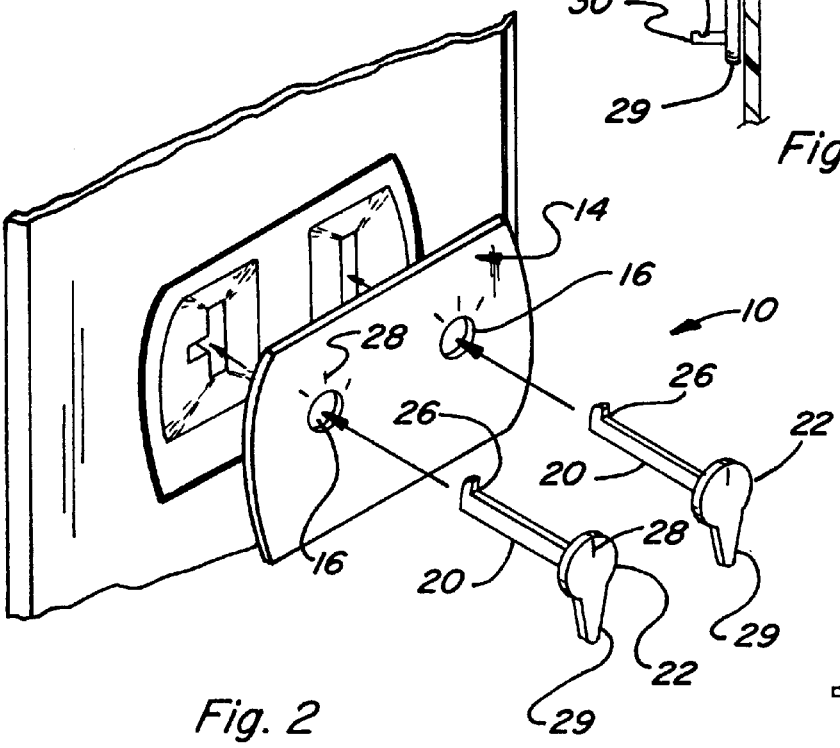
FIG. 2 is an exploded perspective view of a safety cap according to the present invention.

Referring to the drawings, FIG. 2 shows an exploded view of a preferred embodiment of the present invention for a safety cap 10 for an electrical wall outlet 12 including a face plate 14 with one, two, or three openings 16 therein. The openings 16 are spaced so that each one overlays a prong receptacle slot 18 in the electrical wall outlet 12. A disk 22, having a prong 20 attached to one side of the disk 22, is placed within each of the openings 16 for rotatable mounting therein. The prong 20 may have any desired cross-section, such as a rectangle (as shown), a circle, or an ellipse. As shown in FIG. 3, the disk 22 has an annular groove 23 around at least a portion of the periphery to provide means for retaining the disk 22 in the opening 16. The openings 16 in the face plate 14 are sized to allow the disk 22 to rotate and the edges of the openings 16 may be rounded or beveled to engage the annular groove 23 of the disk 22.

Figure 1:
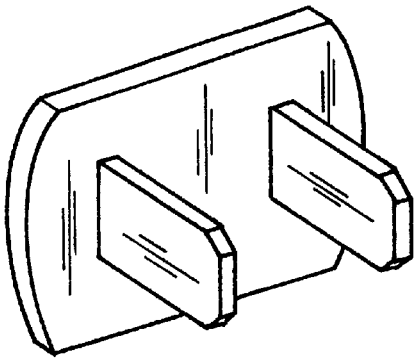
(PRIOR ART) Fig. 1
FIG. 1 is a perspective view of a prior art safety cap.
Figure 3A:
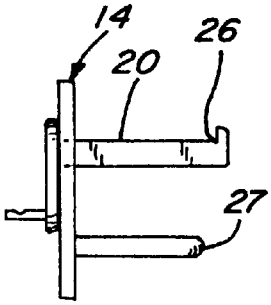
FIG. 3*a* is a side view of a safety cap according to the present invention.

Standard electrical wall outlets 12 have inner, electrically conductive walls (not shown) extending some distance into each slot 18 from the opening of the slot 18. The length of the prong 20 extends into the receptacle when the prong 20 is inserted in the electrical wall outlet 12. The prong 20 is long enough so that a transversely extending member 26 along one side engages the edge of the inner wall of the electrical wall outlet 12 when the prong 20 is rotated in either a clockwise or counter-clockwise direction. The transversely extending member 26 may be placed on the upper or the lower side of the prong 20, or the prong 20 may include two transversely extending member 26, one on the upper side and one on the lower side of the prong 20. More of the prongs 20 may include a transversely extending member 26 to improve retention of the safety cap 10 in the electrical wall outlet 12 when the transversely extending member 26 of each prong 20 engages the edge of the corresponding inner wall. FIG. 3*a* shows a safety cap 14 having one prong 20 with a transversely extending member 26 and another prong 27 without a transversely extending member for a ground plug. The safety cap 14 may be retained in the electrical wall outlet 12 with only one prong 20 having a transversely extending member 26 to engage the inner wall of the outlet 12. Prongs 20 including transversely extending members 26 may also be used in the other openings 16 to increase retention of the safety cap 14 in the outlet 12. Alternatively, prongs 27 without transversely extending members may be used in one or two of the openings 16 to provide stability when the safety cap 14 is inserted in the electrical wall outlet 12. Further, in order to simplify construction of the present device, the safety cap 14 may include only one opening 16 to accommodate a rotatable disk 22 and prong 20 assembly, while the other prongs may be fixedly attached to the safety cap, as currently found in the prior art safety caps as shown in FIG. 1.

The disk 22 may include an alignment marking 28 to provide an external indication of the position of the prongs 20. Further, alignment markings 28 may be included around the openings 16 in the safety cap 10 to indicate to the user the amount of rotation required to engage the transversely extending members 26 with the edge of the inner wall.

A tab 29 extends from the periphery of the disk 22 to provide means for applying rotational force to the prongs 20 and disk 22. The tab 29 extends from and is coplanar with the flat surface of the disk 22. The tab 29 may be rotated by exerting force along one of the side edges of the tab 29 using a finger or other implement. The tab 29 may be positioned on any portion of the periphery of the disk, however, a preferred embodiment of the present invention as shown in FIG. 4 includes the tab 29 positioned at an angle 37 relative to the vertical direction when the prongs are not rotated.

Figure 4:
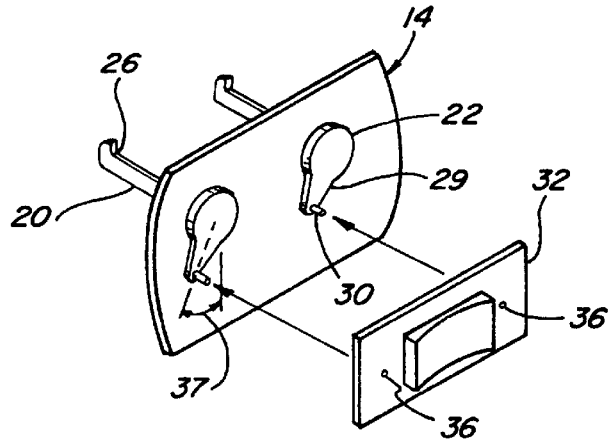
FIG. 4 is a perspective view of a safety cap according to the present invention with a bar for exerting rotational force on rotatable mounting means.
Figure 5:
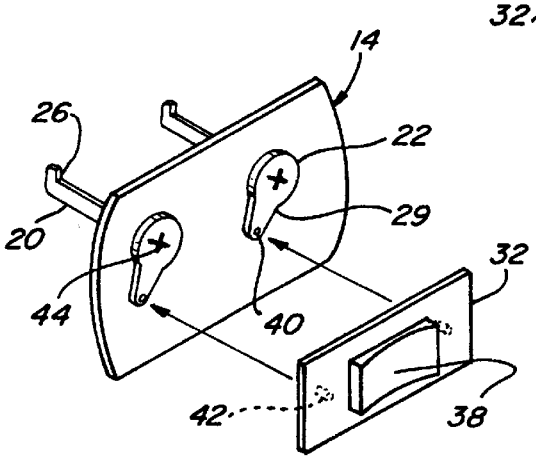
FIG. 5 is a perspective view of a safety cap according to the present invention with another embodiment of means for applying rotational force to the rotatable mounting means.

Alternative means for applying rotational force to the disk 22 include a pin 30 extending from the tab 29 as shown in FIGS. 2 and 3, and a bar 32 as shown in FIGS. 4 and 5. The pin 30 may include means for retaining and stabilizing the bar during use, such as an indention 34 as shown in FIG. 3. The bar 32 has one or more openings 36 for engaging the pins 30 and rotating the disks 22 in the face plate 14. The bar 32 may include one opening 36 so that one disk 22 may be rotated at a time. Alternatively, the bar 32 may be constructed with two openings 36 that fit over both of the pins 30 at the same time. To further facilitate rotation of the tabs 28 with the bar 32, a contoured, raised platform 38 is attached to the bar 32 to provide means for stabilizing the operator's finger or other implement that is used to exert sideways force on the bar 32.

A further alternative means for applying rotational force to the disk 22 is shown in FIG. 5 where the tab 29 includes one or more openings 40 and the bar 32 includes one or more pins 42 that may be inserted in the openings 40. The orientation of the tabs 29 at the angle 37 facilitates applying rotational force to the disk 22 with a bar 32 as movement of the bar 32 is substantially horizontal.

The disk 22 may include slots 44 to accommodate various types of screw drivers (not shown) as a means for applying rotational force to the disk 22. The slots 44 may be included in addition to or instead of the tab 29 as means for applying rotational force to the disk 22.

The present safety cap 10 and prongs 20, 27 are constructed of electrically non-conductive materials that are strong enough to withstand insertion and removal from electrical outlets 12. To use the present safety cap 10, the operator inserts the prongs 20, 27 of the safety cap 10 into the electrical outlet 12 until the face plate 14 abuts the outlet 12. The operator then uses one of the means for rotating the disks 22 disclosed hereinabove to rotate each prong 20 having a transversely extending member 26 until the transversely extending member 26 engages the edge of the inner wall of the electrical outlet 12. If the particular embodiment of the present invention includes markings 28 around the edge of the openings 16 and the disk 22, then the operator may use these to indicate the prong 20 is in the engaged and disengaged position.

Figure 6:
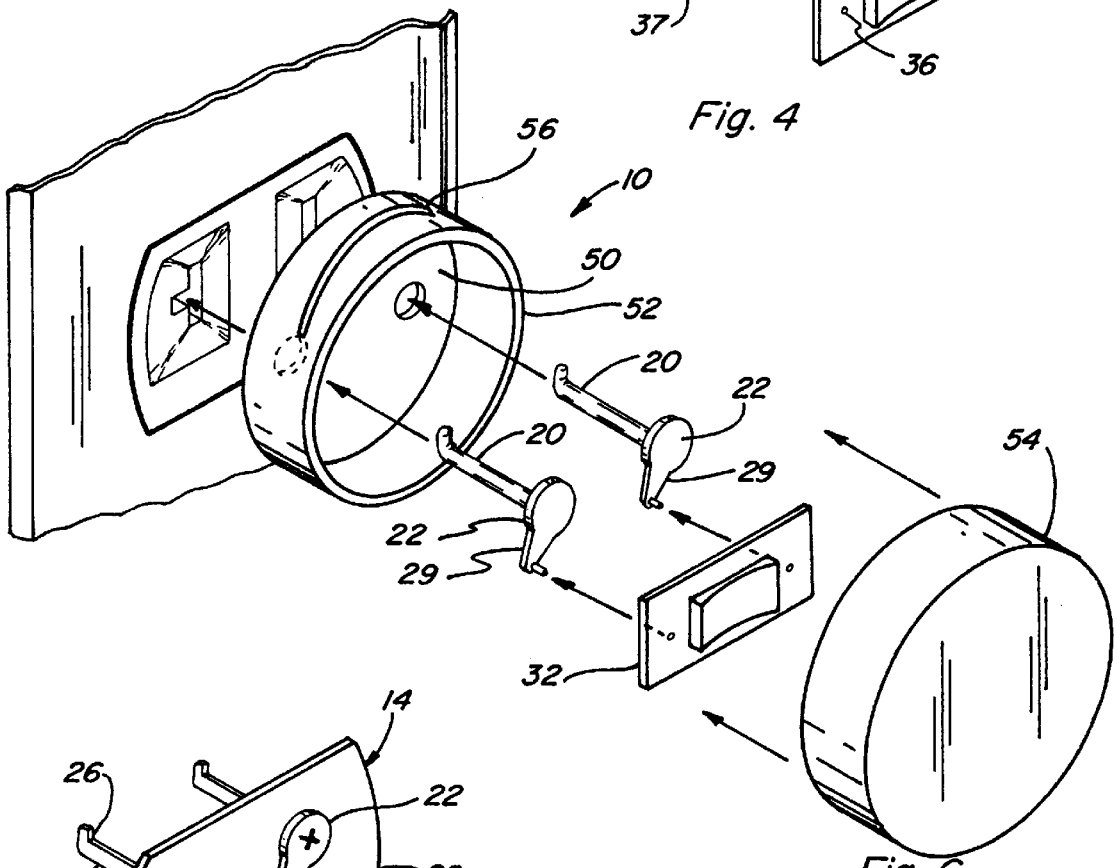
FIG. 6 is an exploded perspective view of an alternate embodiment of a safety cap according to the present invention with a cover for preventing access to the means for applying rotational force to the rotatable mounting means.

FIG. 6 shows an alternate embodiment of the present safety cap 10 having a substantially circular face plate 50 and a rim 52 around the periphery of the face plate 50. The rim 52 includes means for securing a cover 54 over the face plate 50 and rim 52 to prevent unintended rotation of the prongs 20 that may occur when the disks 22 and the tabs 29 are left exposed. The rim 52 may include a thread 56 around a portion of the side to engage a corresponding thread (not shown) around the inner side of the cover 54. The bar 32 should be sized so that it may be moved within the rim 52 to rotate the disks 22 and the prongs 20 to the engaged position. Other means for covering the safety cap 10 shown in FIGS. 2, 4, 5, and 6 may be used, such as a snap-on cover (not shown) that is sized and shaped to fit snugly over the perimeter of the face plate 14 and to be held in place by frictional forces.

It is anticipated that the present invention may be used not only in standard 120 volt electrical wall outlets, but also any other type of electrical outlet wherein prongs of a plug may be inserted.

Other aspects, objects and advantages of the present invention can be obtained from a study of the drawings, the disclosure and the appended claims.

I claim:

1. A safety cap for an electrical outlet comprising:

a face place having an opening;

rotatable mounting means including a disk positioned in the opening of the face plate; and at least one prong having one end attached to one side of the disk and extending substantially normal to the face plate, the at least one prong having a transversely extending member along one edge for fixing the face plate to the electrical outlet.

2. The safety cap, as set forth in claim 1, further comprising means to apply rotational force to the disk including a tab extending from a peripheral portion of the disk, the tab being substantially parallel to the face plate when the disk is positioned in the opening.

3. The safety cap, as set forth in claim 2, further comprising a pin attached proximate the end of the tab, the pin extending substantially normal from the tab and oppositely of the at least one prong.

4. The safety cap, as set forth in claim 3, further comprising means to apply rotational force to the disk including a bar having an opening proximate one end for engaging the pin to exert rotational force on the disk.

5. The safety cap, as set forth in claim 2, further comprising means to apply rotational force to the disk including an opening proximate the end of the tab, the opening being sized to receive a pin member.

6. The safety cap, as set forth in claim 1, further comprising means to apply rotational force to the disk including at least one slot in the disk for engaging a screwdriver.

7. The safety cap, as set forth in claim 2, further comprising an annular groove around at least a peripheral portion of the disk for engaging the edge of the opening in the face plate when the disk is positioned in the opening.

8. The safety cap, as set forth in claim 1, further comprising at least one marking on the disk to indicate the rotational position of the at least one prong.

9. The safety cap, as set forth in claim 1, further comprising a marking on the disk and at least one marking around the edge of the opening to provide an indication of the rotational position of the at least one prong.

10. The safety cap, as set forth in claim 1, further comprising a cover attachable to the safety cap to prevent access to the rotatable mounting means.

11. A safety cap for an electrical outlet comprising:

a face plate having two openings;

rotatable mounting means including a disk positioned in each corresponding opening in the face plate; and two prongs, each prong having one end attached to one side of the corresponding disk and extending substantially normal to the face plate, each prong having a transversely extending member along one edge for fixing the face plate to the electrical outlet.

12. The safety cap, as set forth in claim 11, further comprising means to apply rotational force to each disk including a tab extending from a peripheral portion of each disk, the tab being substantially parallel to the face plate when each disk is positioned in the corresponding opening.

13. The safety cap, as set forth in claim 11, further comprising a pin attached proximate the end of the tab, the pin extending substantially normal from the tab and oppositely of the prongs.

14. The safety cap, as set forth in claim 13, further comprising means to apply rotational force to the disk including a bar having two ends and an opening proximate each end, the openings in the bar being spaced to engage one pin in each opening to provide means for applying rotational force to each disk.

15. The safety cap, as set forth in claim 12, further comprising means to apply rotational force to the disk including an opening proximate the end of the tab, the opening being sized to receive a pin member.

16. The safety cap, as set forth in claim 11, further comprising an annular groove around a peripheral portion of each disk for engaging the edge of the corresponding opening in the face plate when each disk is positioned in the corresponding opening.

17. The safety cap, as set forth in claim 11, further comprising a third prong for inserting into a ground plug receptacle of the electrical outlet.

18. The safety cap, as set forth in claim 14, wherein the bar includes a concave portion for stabilizing the implement used to exert rotational force on the disk.

19. The safety cap, as set forth in claim 11, further comprising at least one marking on the disk to indicate the rotational position of the at least one prong.

20. The safety cap, as set forth in claim 11, further comprising a cover including means for attaching the cover to the safety cap to prevent access to the rotatable mounting means when the prongs of the safety cap are engaged in the electrical outlet.

* * * * *